US007084339B2

(12) United States Patent
Rundle

(10) Patent No.: US 7,084,339 B2
(45) Date of Patent: Aug. 1, 2006

(54) FOAM CORE MULTI ROD DRUM STICK

(76) Inventor: David Chappell Rundle, 2291 Britannia Rd, RR #3, Campbellville, Ontario (CA) L0P 1B0

( * ) Notice: Subject to any disclaimer, the term of this patent is extended or adjusted under 35 U.S.C. 154(b) by 0 days.

(21) Appl. No.: 10/967,004

(22) Filed: Oct. 15, 2004

(65) Prior Publication Data

US 2006/0081117 A1 Apr. 20, 2006

(51) Int. Cl.
*G10D 13/02* (2006.01)

(52) U.S. Cl. ..... 84/422.4

(58) Field of Classification Search ..... 84/422, 84/1, 422.4; 446/265, 422
See application file for complete search history.

(56) References Cited

U.S. PATENT DOCUMENTS 4,535,671 A * 8/1985 Stromberg et al. ..... 84/422.4
4,570,527 A * 2/1986 Pruitt ..... 84/422.4
5,728,958 A * 3/1998 Vater ..... 84/422.4
6,002,077 A * 12/1999 Nicolosi ..... 84/422.4

* cited by examiner

*Primary Examiner*—Kimberly Lockett

(57) ABSTRACT

A stick type drumstick is disclosed which includes a plurality of elongated reasonably straight wooden rods formed around a central foam core. The central foam core is comprised of a larger diameter sized wooden rod, shorter in length and having attached to one end a foam rod of the same diameter. The plurality of rods matching the length of the central foam core are placed around its outside diameter, a retaining sleeve is securely fitted over the gripping end creating a handle. At the opposite or playing end an additional retaining sleeve shorter in length is secured slightly back from playing end allowing some flexibility for the outer rods but not allowing them to spread or splay allowing the foam core to slide out of position.

16 Claims, 1 Drawing Sheet

FOAM CORE MULTI ROD DRUM STICK

BACKGROUND OF THE INVENTION

1. Field of Invention

The present invention relates to drumsticks and, more particularly, to a unique wooden stick type drum stick with improved rebound and impact absorbing properties contributing to inherent percussive characteristics unique to its construction.

2. Description of the Prior Art

In the prior art there have been three types of drumsticks. The brush type which typically produces a sweeping sound and the stick type which is used to produce a much stronger or more percussive sound. In the prior art stick type drumsticks were made of elongated round, generally cylindrical solid wood members that were tapered near both ends. One of the end typically was in the shape of a ball-like head which was used to beat on the drum.

The brush type drumsticks were usually made up of a plurality of metal filaments secured to a handle. One improved embodiment of a brush type drumstick is shown in U.S. Pat. No. 4,200,026. That invention involves the use of multiple plastic strands arranged in a tight bundle which is fixed at one end as by molding or fusing to form a handle. The plastic strands are free to spread out at the other end to achieve the brush sound when used. That drumstick although an improvement over prior art brush sticks offers only limited use as a percussive stick owing to its basically soft and flexible nature.

In U.S. Pat. No. 4,535,671, that patent provides certain playing characteristics suitable for certain applications. This drumstick invention includes a bundle wooden rods or dowels bound together to form a long hexagonal shape, the striking or playing end is bound together near its end. The binding medium can be plastic tape, glue or PVC shrink tubing. When struck on a playing surface the interaction of the individual dowels yields a variety of percussive sounds. That drumstick though a subjective alternative over prior art brush sticks its construction offers minimal rebound characteristics, its small diameter sized woods rods through interaction and force of impact under loud musical conditions are subject to damage. Its hexagonal shape is a departure from a traditional grip and requires user adaptation.

There remains a need in the stick drumstick art for a new and distinctive type of drumstick which offers improved properties, is more responsive and critical to rebound, will be reasonably protected during the force of impact increasing its longevity by means of its alternate construction. And by the very nature of the material components contribute its own unique tonal characteristics.

SPECIFICATION

The following description outlines the specific procedures to make a foam core multi rod drumstick;

Step 1: Central foam core as depicted in FIG. 1.

Materials: 2" masking tape, 4" closed cell polyethylene, 12" ⅜" diameter maple dowel.

Procedure: Join the 4" foam to the 12" dowel rod by wrapping the 2" tape around two.

Step 2: Multi rod central foam core drumstick as depicted in Dig. 2

Materials: ¾" PVC Shrink tubing cut to 8", ¾" PVC Shrink tubing cut to 2", heat gun, 1" masking tape, 12⅛" birch dowels, 1⅝" vinyl cap, glue.

Procedure: form the 12⅛" dowels around the central foam core.

Insert the 8" tube over the ⅛" and ⅜" maple dowel end. Apply heat with the heat gun to the 8" shrink tube. ⅛" birch dowels will be pulled tight to the central foam core forming the handle grip.

At a distance of approximately 3½" from the foam end wrap the 1" tape around the outer birch rods 2 times. Insert the ¾" 2" PVC heat shrink tubing and center it evenly over the 1" tape. Apply sufficient heat with the heat gun to shrink around the 1" tape. Glue the end cap on to the maple dowel end. Trim the opposite playing end to even the dowels.

SUMMARY OF THE INVENTION

The drumstick of the present invention includes multiple rods of reasonable straightness formed around a central foam core. The central foam core is comprised of a larger diameter sized wooden rod, shorter in length and having attached to one end a foam rod of the same diameter. The multiple rods matching the length of the central foam core are placed around the outside diameter, a retainer sleeve is securely placed at the gripping end creating a handle, a small cap may be provided for the end of the retainer. At the opposite playing or striking end an additional retainer sleeve is secured slightly back from the playing end. It is important to secure this retaining sleeve at a position where the dowels cannot spread or splay allowing the foam core to slide out of position. The central foam core is round in shape and therefore with the addition of the outside dowels and retaining sleeves the shape remains round. Drumsticks fabricated in accordance with the present invention incorporating a central foam core provide substantial rebound and bounce, the foam core aids in the longevity of the outside wood rods or dowels by providing an internal cushion to absorb a significant portion of the force during impact. The round shape of the gripping area is more akin to a traditional shaped drumstick therefore requiring minimal adaptation in tactile memory. In addition, the unique features of the central foam core provide an enhanced rebound thus providing the percussionist less demanding technical approach when playing musical passages at high tempos and low volume levels. During musical passages that require louder volume and more physical force the central foam core aids in the longevity of the outside wood rods or dowels by providing an internal cushion to absorb a significant portion of force during impact. By the very nature of the material components, the interaction of the central foam core and the individual wood rods create a distinct and unique percussive sound contributing to its own unique tonal characteristics.

BRIEF DESCRIPTION OF THE DRAWINGS

In the drawings wherein like numerals are used to depict like parts throughout the same.

DESCRIPTION OF THE PREFERRED EMBODIMENTS

Figures 1, 2, 3, 3A, 4, 5, 6, 6A:
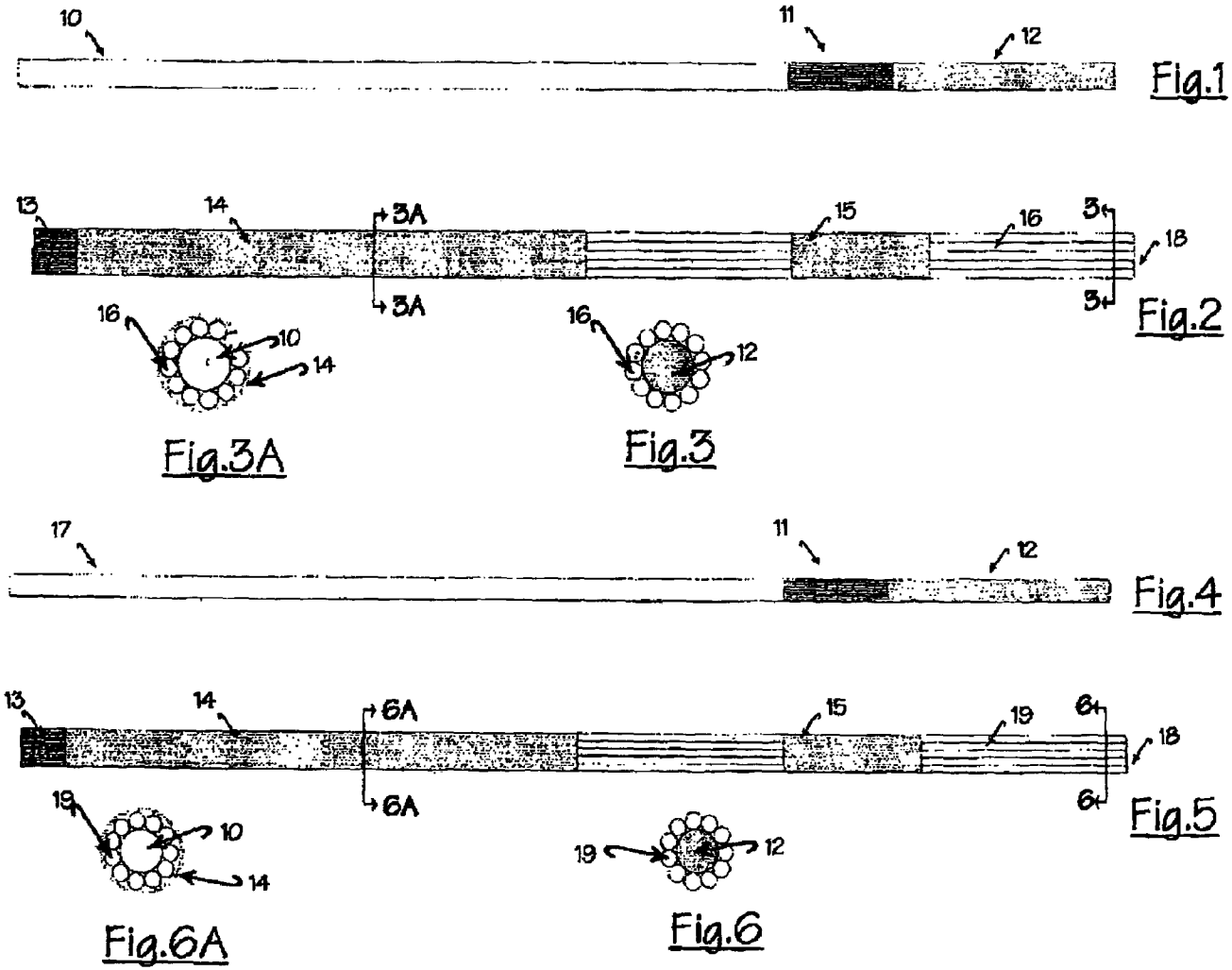
FIG. 1 is a side view of the central core
FIG. 2 is a side view depicting the embodiment of the drumstick of the invention.
FIG. 3 is an enlarged cross-sectional view along line 3—3 of FIG. 2.
FIG. 3A is an enlarged cross-sectional view along line 3A—3A of FIG. 2.
FIG. 4 is a side view of the central foam core using a smaller diameter size wood rod and foam than those depicted in FIG. 1.
FIG. 5 is a side view depicting the embodiment of the drumstick of the invention using smaller diameter outer dowels than those depicted in FIG. 2.
FIG. 6 is an enlarged cross-sectional view along line 6—6 of FIG. 5.
FIG. 6A is an enlarged cross-sectional view along line 6A—6A of FIG. 5.

FIG. 1 depicts the central foam core of the present invention. The central foam core includes a reasonably straight elongated ⅜ inch wooden rod or dowel approximately 12 inches long. Attached to one end of the ⅜ inch dowel is a 4 inch long foam rod. An example of the foam rod can be a closed or open cell polyethylene foam. The foam can be attached with variety of tapes. An example of this tape can be a simple painters masking tape.

FIG. 2. shows the embodiment of the present design in which the bundle of rods 16 having the substantially flat planer end surface 18 is bound tightly together at 14 which becomes the handle and at 15 which holds the dowels together and secures the central foam core in its internal position. It is important to secure 15 at a position from the striking end where the dowels 16 cannot spread or splay allowing the central foam core to slide out of position. A decorative end cap 13 is glued onto the handle end 14.

It will be appreciated that the wooden rods of the drumstick of the invention may be fabricated of any suitable hardwood, the outer wooden rods or dowels could be substituted with plastic or nylon rods depending on the degree of stiffness and resilience desired. Examples of possible woods include birch, oak, maple, ramen, ash or bamboo. As shown in FIG. 3, and FIG. 3A the cross-sectional shape of the wooden rods is round. The particular number of rods used may vary depending on the diameter of the central foam core. For example in the FIG. 1, the chosen diameter is ⅜ inch. In this case, 12 individual ⅛ inch diameter dowels will fit around the outer circumference of the central foam core. In FIG. 4 a 5/16 inch central foam core will utilize 11 individual 3/32" to 7/64" bamboo rods. It has also been found that plastic or nylon outer materials of smaller round diameters will form very well around the central foam core.

Further, it will be appreciated as indicated above, the central foam core can be altered in diameter size, since this changes its circumference it is possible to accommodate different diameter sized outer rods thus enabling a variety of different mediums such as nylon, plastic or bamboo. This is depicted in FIG. 4, FIG. 5, FIG. 6 and FIG. 6A.

As previously discussed the retainer sleeves as at 14 and 15 may be any suitable fastening material such as plastic tubes or cloth tape or the like or even harder materials such as metal or nylon tubes. The material selected in FIG. 3A, 17 is a PVC variety known as polyvinyl chloride.

The number of outer rods or dowels may vary depending on the diameter of the central foam core. The common overall length has been found to be 16 inches. However, various lengths may be employed according to personal preference, practicality reasons an overall length within a 15 to 17 inches has been the most suitable. The retainer sleeve material may also be any material capable of binding the bundle of wooden rods tightly to the inner central foam core. This may be a heat shrinkable material such as a thin polyvinyl chloride (PVC) sleeve. In the above example, a ¾ inch diameter PVC sleeve having a 0.025 inch wall thickness was used. While it is preferable that the rods be of equal length, the discrepancies in length can be compensated in the handle after the playing ends are aligned or one can elect to trim or sand the ends even in a final operation at 18.

One successful embodiment as in FIG. 2 has been fabricated by the procedure which follows. A bundle of 12 ⅛ inch diameter birch dowels 16 inches long were formed around the outside of the central foam core FIG. 1 into a bundle, such that the playing ends were aligned to form a even end surface 18. A thin polyvinyl chloride (PVC) retainer sleeve 5 inches to 8 inches has been inserted over the outer rods 14. After applying sufficient heat to the PVC, it will shrink, pulling the outer wooden rods into a tight configuration surrounding the central foam core resulting in a round shape for a handle area 5 inches to 8 inches in length. A decorative cap was then applied to the handle end over the sleeve 13.

A 1-inch span of tape has been used for the retainer 15 which begins 3 inches from the playing or striking end is wrapped around the circumference at distance that retains the central foam core in its given position. A 2 inch piece of PVC is centered over top of the 1 inch tape and heat sufficient to shrink the sleeve to achieve a tight fit over the tape results in a retainer that bundles the rods sufficiently to hold the central foam core in its internal position.

Drumsticks fabricated in accordance with the present invention incorporating a central foam core provide substantial rebound and bounce. The central foam core aids in the longevity of the outside wood rods or dowels by providing an internal cushion to absorb a significant portion of force during impact. The round shape of the gripping area is more akin to a traditional shaped drumstick therefore requiring minimal adaptation in tactile memory. By the very nature of the material components, the interaction of the central foam core and the individual wood rods create a distinct and unique percussive sound contributing to its own unique tonal characteristics.

These unique features are derivatives of the central foam core and aid the percussionist in technical demands and contribute unique percussive sound alternatives.

The invention claimed is:

1. A stick type drumstick comprising: a central foam core surrounded by individual outer hardwood rods, said outer hardwood rods in adjacent parallel formation around the said central foam core form a round bundle; said bundle having two ends and a longitudinal axis; first retaining means securing said bundle tightly together in a band-like manner for a relatively short longitudinal span at a location spaced from but closer to the playing end thereof; and second retaining means securing the said bundles together at the handle end thereof.

2. The drumstick of claim 1 wherein a said central foam core comprised of a wood rod and a foam rod connected end to end by means of tape and being of the same length of the said individual outer hardwood rods.

3. The foam rod in claim 2 is said to be of a compressible variety.

4. The drumstick of claim 2 wherein the said central foam core is a ⅜ inch diameter.

5. The drumstick of claim 4 wherein the diameter of the said individual outer hardwood rods is a ⅛ inch diameter.

6. The drumstick of claim 4 wherein the number of said individual outer hardwood rods is 12.

7. The drumstick of claim 1 wherein further comprising overlay retaining means for binding said bundle together, said overlay retaining means enveloping said bundle and extending from the handle end of the bundle to the point inclusive of the said first retaining means.

8. The drumstick of claim 7 wherein said overlay retaining sleeve means comprises a heat shrinkable sleeve.

9. The drumstick of claim 1 wherein the number of said individual straight rods formed around the said central foam core results in a substantially round cross-sectional shape.

10. The drumstick of claim 1 wherein said hardwood is one selected from the group consisting of birch, maple, ramen, oak or bamboo.

11. The drumstick of claim 1 wherein the playing or striking end of the bundled wooden rods are aligned to form a substantially even surface perpendicular to the longitudinal axis.

12. The drumstick in claim 1 where second retaining includes an amount of glue.

13. The drumstick in claim 1 where the first retaining includes an amount of tape.

14. The drumstick of claim 1 wherein the said central foam core is 5/16 inch diameter.

15. The drumstick of claim 14 wherein the diameter of the said outer hardwood rods is 1/8 inch diameter.

16. The drumstick of claim 14 wherein the number of diameter outer hardwood rods is 11.

* * * * *